US006364647B1

(12) United States Patent
Sanborn

(10) Patent No.: US 6,364,647 B1
(45) Date of Patent: Apr. 2, 2002

(54) THERMOSTATIC MELT BLOWING APPARATUS

(76) Inventor: David M. Sanborn, 444 Redondo Dr., Suite 212 Downers Grove, IL (US) 60516

( * ) Notice: Subject to any disclaimer, the term of this patent is extended or adjusted under 35 U.S.C. 154(b) by 0 days.

(21) Appl. No.: 09/168,821

(22) Filed: Oct. 8, 1998

(51) Int. Cl.[7] ..... D01D 5/14
(52) U.S. Cl. ..... 425/7; 425/72.2; 425/192 S
(58) Field of Search ..... 425/7, 72.2, 382.2, 425/464, 186, 190, 192 S

(56) References Cited

U.S. PATENT DOCUMENTS

| | | | | |
|---|---|---|---|---|
| 3,379,811 A | | 4/1968 | Hartmann et al. | |
| 3,437,725 A | | 4/1969 | Pierce | |
| 3,441,468 A | | 4/1969 | Siggel et al. | |
| 3,737,506 A | | 6/1973 | Martin et al. | |
| 3,755,527 A | | 8/1973 | Keller et al. | |
| 3,758,658 A | | 9/1973 | Riggert | |
| 3,762,003 A | * | 10/1973 | Frezza | |
| 3,825,379 A | | 7/1974 | Lohkamp et al. | 425/72.2 |
| 3,825,380 A | | 7/1974 | Harding et al. | 425/72.2 |
| 3,849,241 A | | 11/1974 | Butin et al. | |
| 3,888,610 A | | 6/1975 | Brackmann et al. | 425/72.2 |
| 3,954,361 A | | 5/1976 | Page | 425/72.2 |
| 3,970,417 A | | 7/1976 | Page | 425/72.2 |
| 4,295,809 A | | 10/1981 | Mikami et al. | 425/464 |
| 4,380,570 A | | 4/1983 | Schwarz | 425/80.1 |
| 4,731,215 A | * | 3/1988 | Schwarz | |
| 5,079,080 A | * | 1/1992 | Schwarz | |
| 5,476,616 A | * | 12/1995 | Schwarz | |
| 5,860,251 A | * | 1/1999 | Gleich | |
| 6,013,223 A | * | 1/2000 | Schwarz | |

* cited by examiner

*Primary Examiner*—Nam Nguyen
*Assistant Examiner*—Joseph Leyson
(74) *Attorney, Agent, or Firm*—Arthur W. Fisher III

(57) ABSTRACT

An apparatus for melt blowing thermoplastic fibers especially suited for recycled plastic where molten polymer is extruded through a die head into an array of removable nozzles, each nozzle having a shoulder back end in contact with the die head, and discharged into ambient air while surrounded by a high velocity, high volume discharge of hot air wherein the nozzles are inserted through an array of nozzle holes in the back end of a strand plate bolted to the die head, and pass through an air chamber defined by the interior of the strand plate, air is heated to high temperatures with a direct flame and channeled to the air chamber, the outside face of the back end of the strand plate includes recessed areas corresponding to each nozzle hole, for receiving the shoulder back end of each nozzle, each of the nozzles can be serviced and replaced simply by releasing the strand plate and withdrawing one or more nozzles therefrom, a desired spatial configuration of and proper alignment of the nozzles is maintained with alignment strands placed between the rows and columns of nozzles such that the alignment strands and nozzles are in tangential contact, a cover plate with orifices corresponding to and concentric with each of the removable nozzles and having an inner diameter larger than the outer diameter of the nozzles can be placed over the array of nozzles and alignment strands such that the nozzles extend through the concentric orifices forming an annulus around the nozzles for uniform discharge of high velocity, high volume hot air around the discharged molten polymer.

20 Claims, 6 Drawing Sheets

THERMOSTATIC MELT BLOWING APPARATUS

BACKGROUND OF THE INVENTION

1. Field of the Invention

This invention relates generally to thermoplastic melt blowing for producing nonwoven plastic textiles. In particular, the invention relates to an apparatus and method for using an array of removable nozzles for discharging molten polymer.

2. Description of the Prior Art

Traditionally, synthetic fibers were, and in some instances still are, produced from thermoplastics extruded through a die that feeds spinnerets. The spinnerets split the molten plastic into thousands of tiny filaments which are then mechanically stretched, cooled and sometimes chemically treated to yield the desired fiber. The plastic fibers can be used to form plastic textiles.

More recently, a new process for forming thermoplastic fibers has been developed known as melt blowing, in which the fibers and subsequent textiles are formed in a simple continuous process. To melt-blow plastic fibers, jetstreams of heated air are placed in close proximity to the plastic filaments exiting from specialized strand plates fed by an extruder. The field of rapidly moving air, exhaust velocity of several thousand feet per second, transforms the plastic filaments into fibers and delivers the airborne fibers to a collection drum or belt where a fibrous web is formed through random mechanical entanglement and heat bonding of the fibers. The distance between the drum and the die plate, as well as other factors well known to those skilled in the art, determine the various characteristics of the fibrous web products and its utility. Various uses include thermal and acoustical insulation, batting for pillows, stuffing for mattresses and comforters, clothing insulation and construction, absorbents for hydrocarbons and chemicals, and wipes.

The field of melt blowing has many patents relating to the die head, the molten plastic orifice, the gas orifice, desired temperatures and velocities, and preferred thermoplastics. One of the early patents in the field, U.S. Pat. No. 3,379,811, issued on Apr. 23, 1968 to Hartmann, describes and claims an apparatus and method for melt blowing molten polymer in which a fluid stream for attenuating the exiting polymer into filaments is provided through two channels and their corresponding orifices located on opposite sides of each polymer discharge orifice.

U.S. Pat. No. 3,441,468, issued on Apr. 29, 1969 to Siggel, describes and claims a method for producing non woven felt-like textiles from melt-blown synthetic polymers by combining a non shrinkable polymer extruded into a stream of hot steam and a shrinkable polymer extruded into a stream of hot gas.

U.S. Pat. No. 3,755,527, issued on Aug. 28, 1973 to Keller, describes and claims a process for melt blowing plastic textiles having a high tear resistance. Molten polymer material is extruded between two knife edge streams of hot gas. Specific temperature, flow rates and viscosity limits, as well as the distance between the discharge orifices and collection drives for a specific filament diameter, are described in the patent.

U.S. Pat. No. 3,825,379, issued on Jul. 23, 1974 to Lohkamp, describes and claims a melt blowing die in which the thermoplastic is discharged through capillary tubes soldered in channels milled in the die. The milled channels are believed to enable alignment of the discharge orifices within tight tolerances and less expensively than is possible with channels that are drilled into the die.

U.S. Pat. No. 3,954,361 describes and claims a melt blowing apparatus in which a die head has multiple thermoplastic flow passages surrounded by channels such that gas flow uniformly encircles the thermoplastic flow passages.

In U.S. Pat. No. 4,380,570, issued on Apr. 19, 1983, to Schwarz, an apparatus and process for melt blowing a thermoplastic product is described and claimed wherein the molten polymer is first passed through a first heating zone at low incremental increases in temperature and then rapidly passed through the discharge nozzles at high incremental increases in temperature.

Additional melt blowing apparatus and methods are disclosed in U.S. Pat. Nos. 3,825,380, 3,849,241, 3,888,610, 3,970,417, and 4,295,809. The foregoing patents are all hereby incorporated by reference as if fully set forth herein.

Despite the many advances made in the field of melt blowing plastics during the last twenty five years, many problems still exist which result in an expensive and inefficient process. For example, the molten plastic discharge channels of melt blowing apparatus are typically machined directly into the die, either drilled into the face of the die, or where the die comprises two or more parts coupled together, milled within one or more of the die parts. Due to the large block of steel necessary to provide the required length over diameter ratio of the discharge channels, the diameter generally on the order of ten to thirty thousands of an inch, the channels are expensive to manufacture and difficult to service. If a particular project calls for a different discharge orifice diameter, a new die has to be cast. Even where a solid block is replaced with nozzles soldered to a strand plate, if a discharge orifice, or its corresponding channel becomes clogged which if left this way will result in a non-uniform and low quality textile, it is extremely difficult and expensive, if at all possible, to clear the clog. The expense is both a result of the cost of repair or replacement and production downtime. This is an especially prevalent problem in the field of recycled plastics where the materials used are replete with impurities.

SUMMARY OF THE INVENTION

Accordingly, it is an object of the present invention to provide an efficient and economical method and apparatus for use therewith, for producing melt-blown thermoplastic fibers and non-woven textiles made therefrom. It is also an objective of the present invention to provide high velocity and high volume gas flow uniformly and in close proximity to the discharged molten polymer.

In furtherance of these objectives, the melt blowing apparatus of the present invention comprises an extruder having at one end a die head with one or more openings through which molten plastic is extruded, multiple nozzles each having a shoulder at a back end abutting the openings in the die head for receiving the extruded molten plastic, and a discharge orifice at the front end for discharging the molten plastic into ambient air; a strand plate having an array of nozzle holes at a back end through which the multiple nozzles are inserted; an air chamber defined by the strand plate through which the multiple nozzles pass; and alignment strands for maintaining a desired spatial orientation and alignment of the multiple nozzles.

The long axis of the strand plate of the present invention can be divided into multiple short sections which can be joined to form a single seamless strand plate by forming a seam so as to traverse multiple columns of nozzle passages and providing an additional nozzle passage for each passage in a column lost to the seam.

Ambient air is pumped by any air conveying device such as a compressor into a direct flame chamber in which the air is heated. The heated gas is then channeled, either through the die head and into the air chamber, or directly through the strand plate, into the air chamber.

In accordance with the melt blowing process of the present invention, molten plastic is extruded through a die head and discharged into ambient air through removable nozzles surrounded by high volume, high velocity heated air. Nozzle alignment is maintained by forming an array of alignment strands and placing the nozzles therebetween in tangential contact with the alignment strands. This alignment means also allows for high gas discharge volume and velocity around the nozzles.

A cover plate having an array of holes each with a diameter larger than the outer diameter of each of the multiple nozzles and concentric with and corresponding to the array of multiple nozzles may optionally be placed over the strand plate so that each nozzle passes through a corresponding hole in the cover plate. The cover plate secures the alignment strands in position and also creates an annular path around each nozzle for uniform discharge of the heated air around each nozzle. Alternatively, a retainer plate may be used in lieu of a cover plate to secure the alignment strands and maintain the nozzles in their proper orientation. In this case, the heated air surrounds each nozzle by flowing through the spaces formed between each of the tangential points of contact of the alignment strands and the nozzles. The retainer plate is attached to the strand plate and simply secures the outer perimeter of nozzles or alignment strands, as the case may be, in their desired position.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE INVENTION

Figure 1:
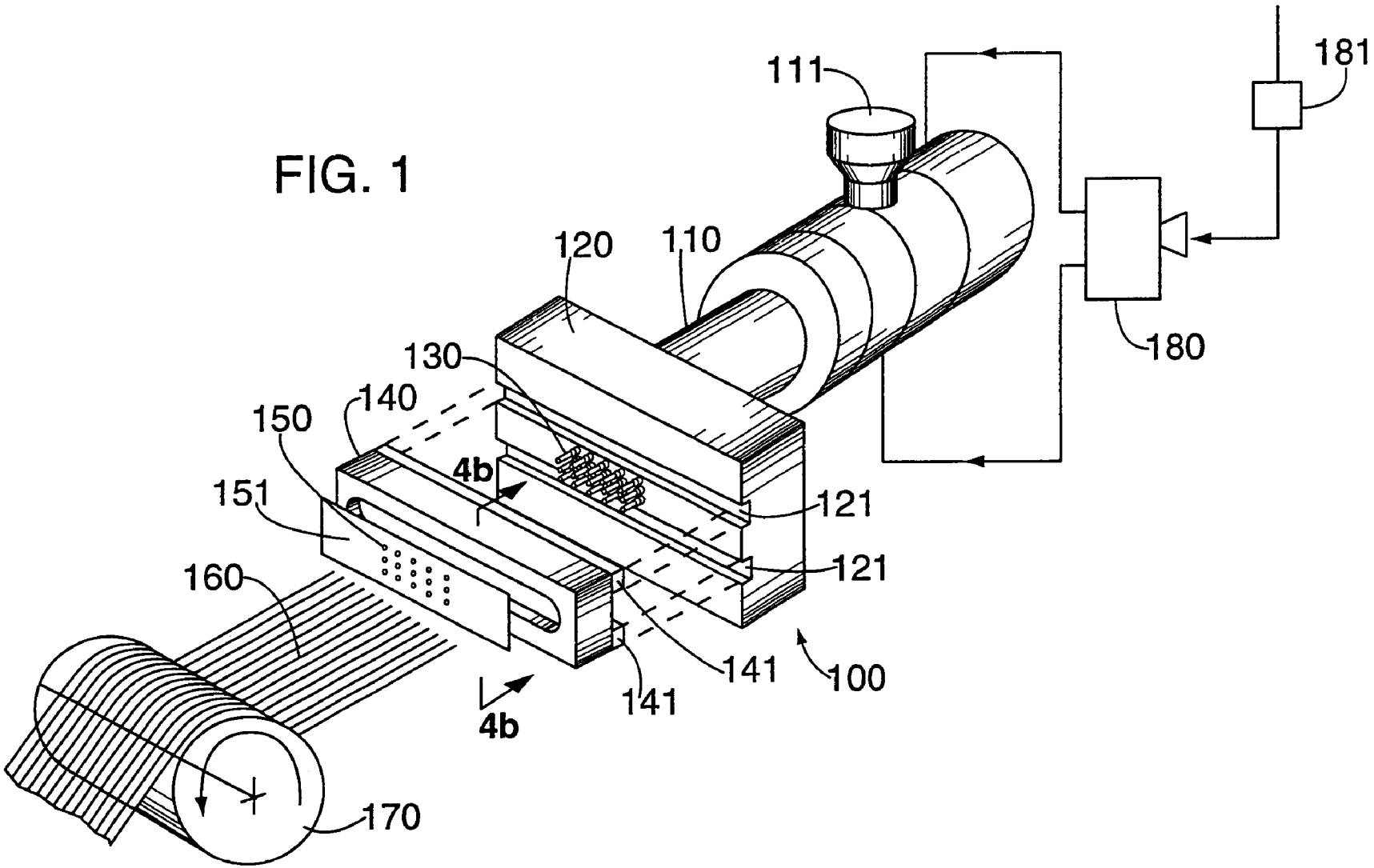
FIG. 1 shows the melt blowing apparatus according of the present invention.
Figure 2:
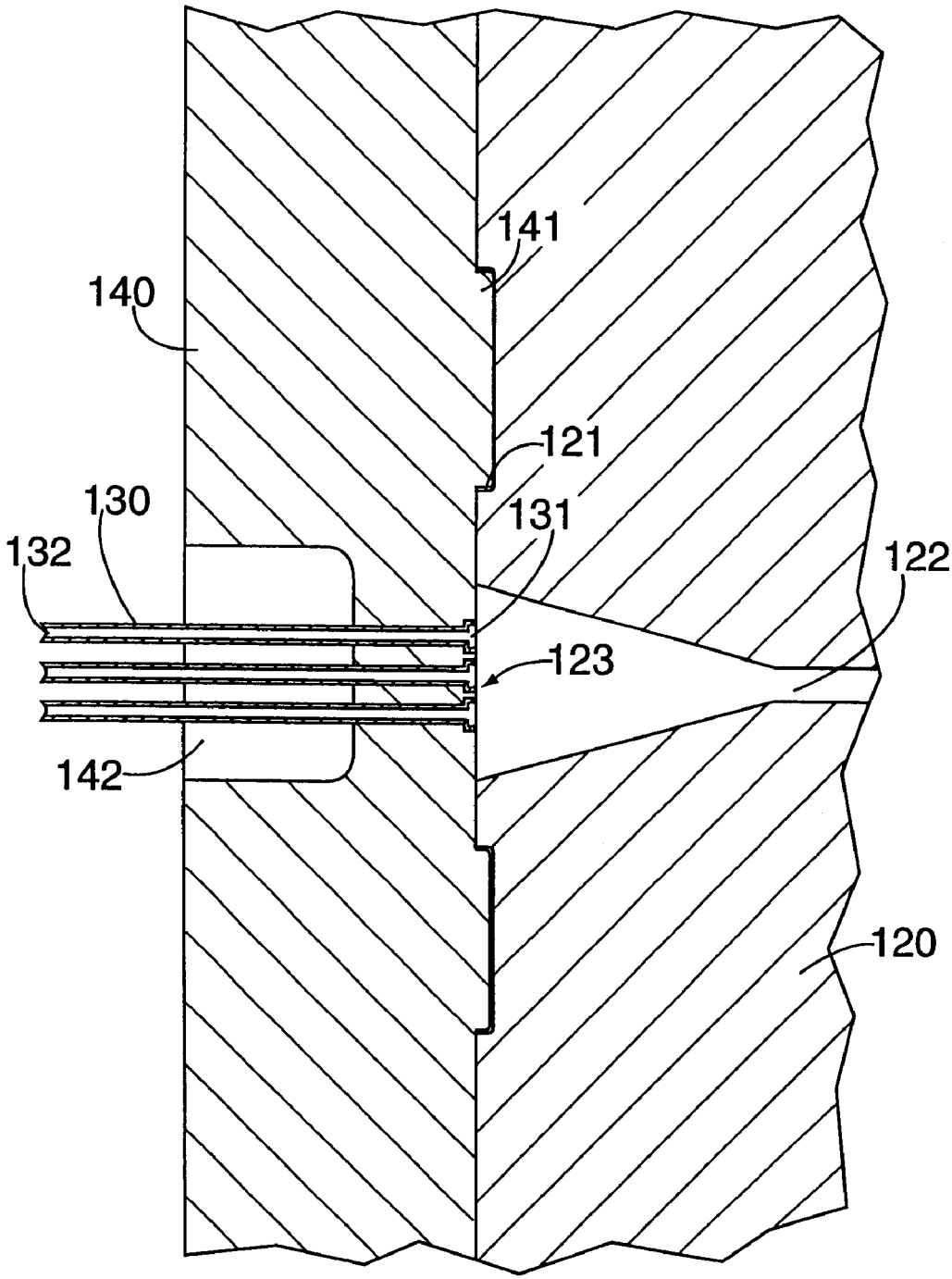
FIG. 2 is an enlarged cross-sectional view of the strand plate bolted to the die head in which the nozzles passing through the back end of the strand plate and through the air chamber is shown.

Referring to FIG. 1, one embodiment of a melt blowing apparatus generally indicated as 100 according to the present invention is shown. Molten plastic is fed through hopper 111 and passed through an extruder 110 to a die head 120. As shown in FIG. 2, the molten plastic passes from the die head 120 through a channel 122 and a die head opening 123. A plurality of nozzles each indicated as 130 are retained within a strand plate 140 coupled to the die head 120 with bolts (not shown) or other suitable coupling means known to those in the art so that the back end of each nozzle 130 rests against the die head opening 123. Die head 120 may also include one or more grooves each identified as 121 to receive a corresponding rib 141 formed on the strand plate 140 for a more secure coupling. It will be obvious to one skilled in the art that the ribs 141 and grooves 121 may be reversed such that the ribs 141 are formed on the die head 120 and the grooves 121 are formed on the strand plate 140. Other variations are within the scope of the present invention as well.

Figure 3:
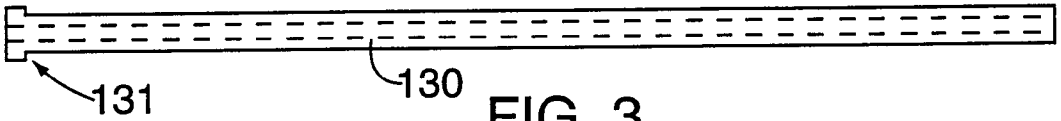
FIG. 3 shows a nozzle of the present invention.
Figure 5:
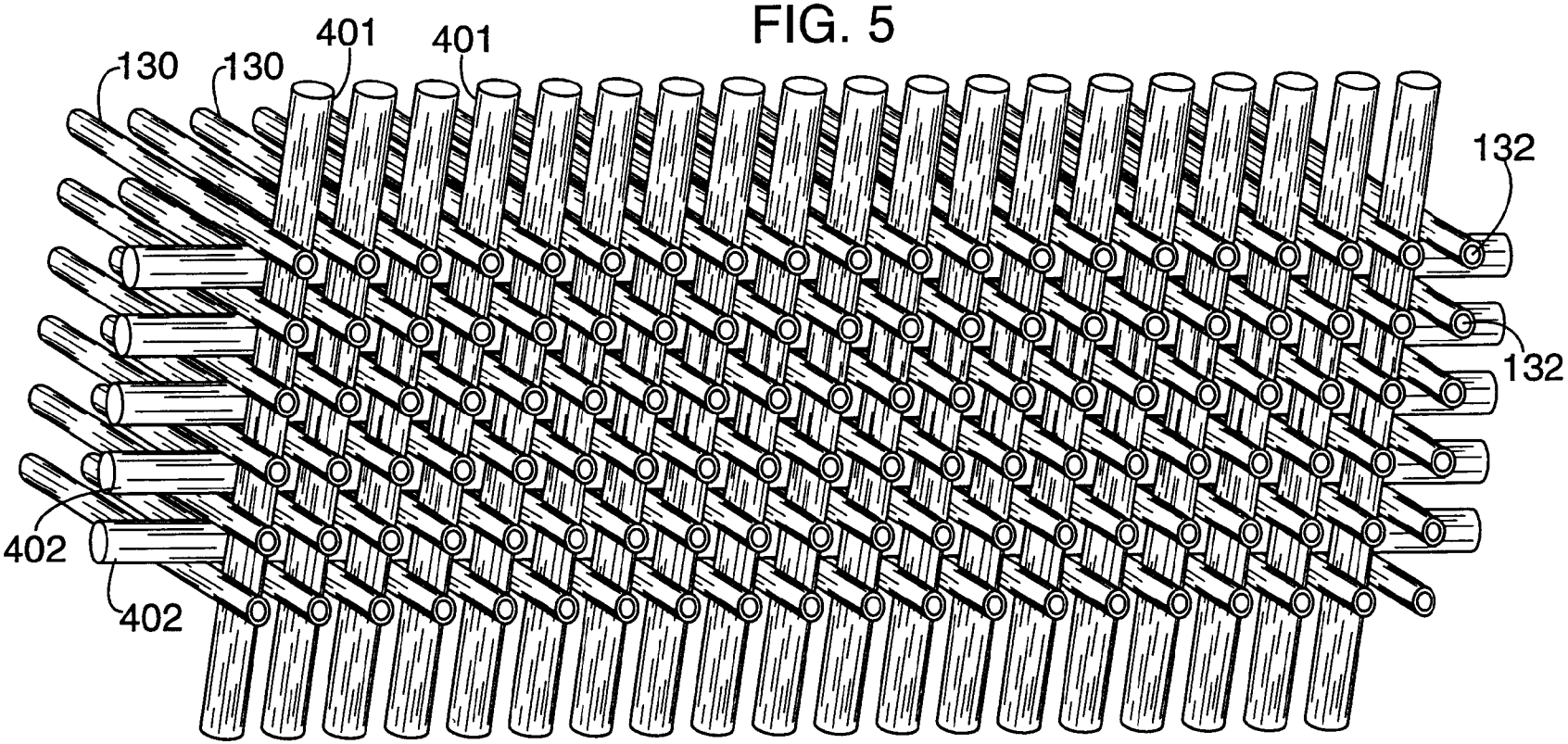
FIG. 5 depicts the cross hatch nozzle alignment of the present invention with column and row alignment strands placed between the rows and columns of and in tangential contact with the nozzles.

As shown in FIGS. 2 and 3, each nozzle 130 has a hollow bore with orifices at the front and back ends thereof which can be manufactured from hypodermic tubing. The back end of each nozzle 130 has a shoulder 131 which rests within the back end of strand plate 140 as described below. During the melt blowing process, the molten plastic is extruded through the die head 120 into the nozzles 130 through the back end orifice and discharged through a discharge orifice 132. Many variations of the orifice diameter, material and dimensions are possible and fall within the scope of the present invention.

Figure 4A:
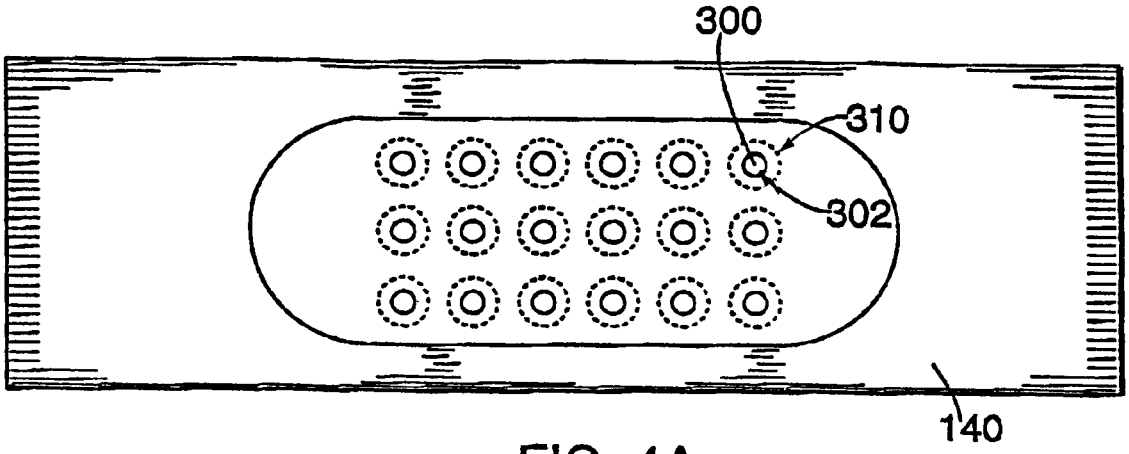
FIG. 4A is a rear view of the back end of the strand plate of the present invention.
Figure 4B:
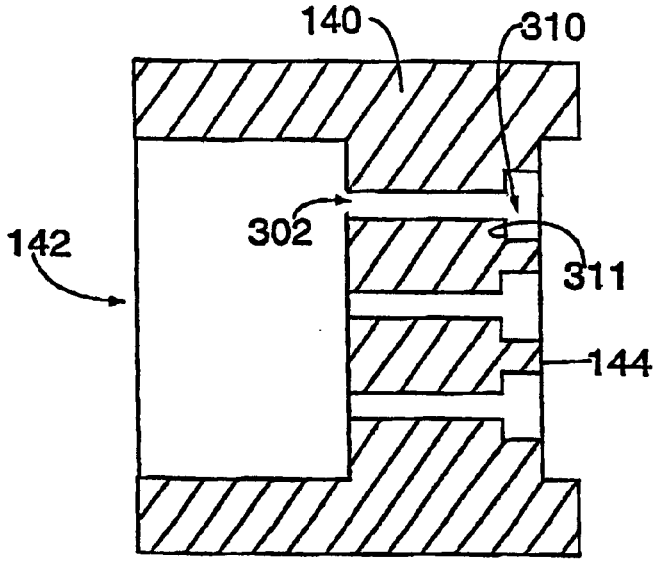
FIG. 4B is a cross-sectional view of the strand plate of the present invention showing recesses for receiving the shoulder back end of the nozzles.

As shown in FIGS. 4A and 4B, each nozzle 130 is received through a corresponding passage 300 in a back wall 144 of the strand plate 140. Each passage 300 comprises an enlarged recess 310 formed in the back wall 144 to receive the shoulder 131 of a corresponding nozzle 130 and an elongated channel 302 extending from the distal end 311 of the enlarged recess 310 to the air chamber 142.

Although removable, each nozzle 130 is securely held in the strand plate 140 within the corresponding passage 300 when the strand plate 140 coupled to the die head 120. The pressure exerted by the molten plastic flowing from the die head 120 creates a seal with the nozzle interior wall preventing leakage of the molten plastic. By removing the strand plate 140 from the die head 120, any nozzle 130 which has become clogged can be exchanged for an unclogged nozzle 130. Furthermore, the relative ease with which the nozzles 130 can be replaced enables a single strand plate 140 to be used to manufacture a variety of products requiring the use of different nozzles 130 simply by changing the nozzles 130 to produce fibers with desired fiber diameters.

Figure 7:
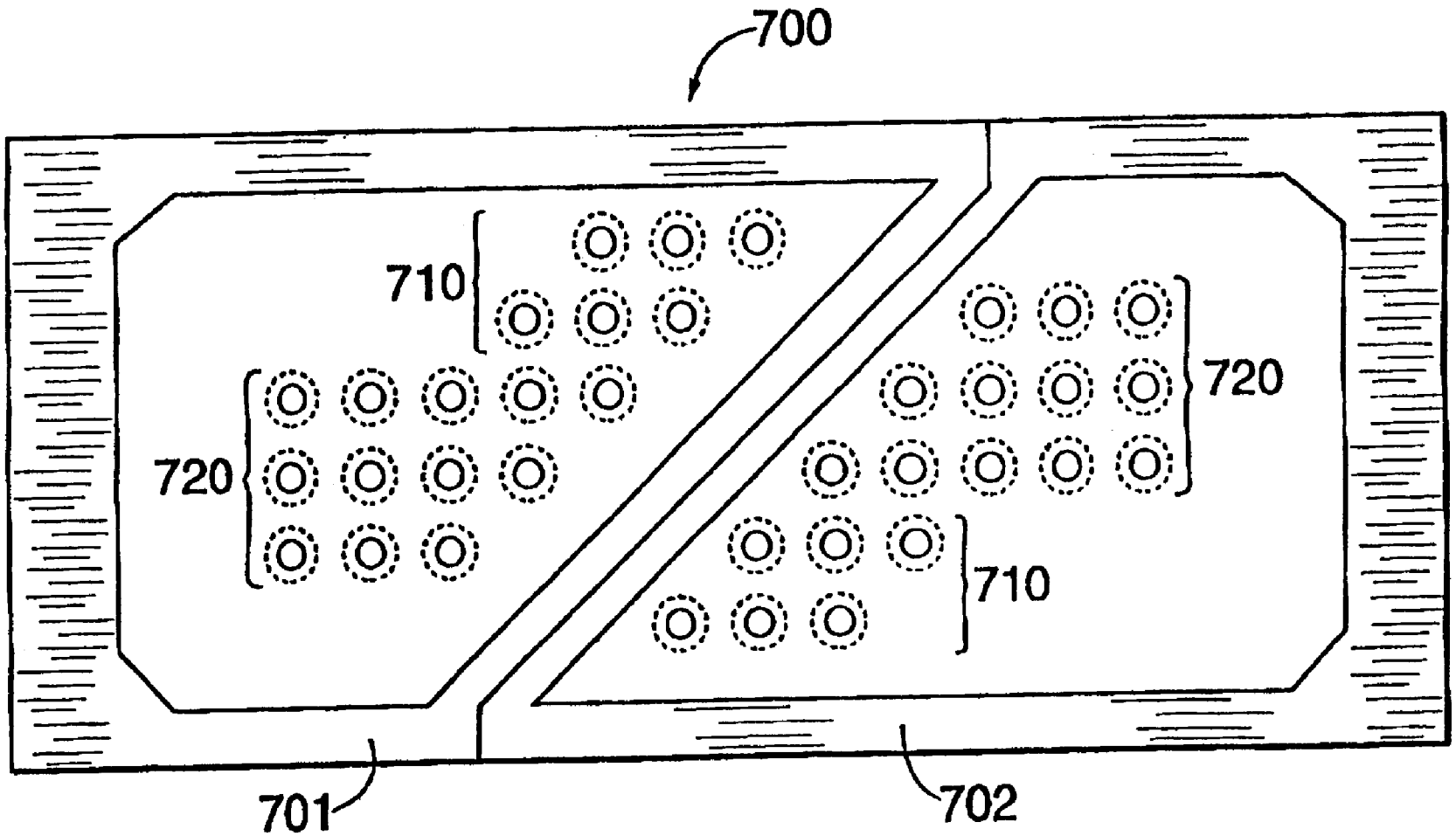
FIG. 7 shows a seamless strand plate of the present invention.

When melt blowing plastic fibers, the discharge orifices 132 are usually arranged in columns and rows with a larger number of columns of discharge orifices 132 relative to the number of rows. To assure uniform and quality product, it is essential that the discharge orifices 132 be properly spaced and that all dimensions be maintained within tolerances. As the orifice diameters are very small relative to the number of columns and therefore the strand plate width, it becomes difficult to manufacture a typical strand plate 140. As shown in FIG. 7, a strand plate assembly is shown comprising a plurality of relatively short sections 701 and 702 joined together to form a single strand plate 700 with the necessary width dimension, that can be used in accordance with the present invention. While any multi-sectional strand plate 700 is easier to machine the passages 300, since only relatively short sections 701 and 702 need to be handled at any one time, the seamless strand plate 700 shown in FIG. 7 minimizes the interruption caused by the seams.

If a vertical seam were created between the sections 701 and 702 of the strand plate 700, it is readily understood that at least one if not more of an entire column of nozzle passages 710 and 720 and consequently nozzles 130 will be lost. For this reason, the seamless strand plate 700 shown here is sectional at an angle other than 90 degrees to the rows of nozzle passages 710 and 720, and an additional nozzle passage 710 is provided either above or below the primary column of nozzle passages 720. For the strand plate section 701 comprising the upper half of the seam, the additional nozzle passages 710 will be placed above the primary columns, and for the strand plate section 702 below the seams, the additional nozzle passages 720 will be placed below the primary columns. It is understood that an embodiment of the present invention utilizing the seamless strand plate 700 described herein would require additional nozzles 130 to pass through the additional nozzle passages 710.

As shown in FIG. 1, in a typical melt blowing process the molten polymer is discharged from the discharge orifices 132 with fibers 160 are formed during the midstream path between the discharge orifices 132 and a take-up drum 170. Random commingling of the fibers in the air and on the take-up drum 170 results in the desired plastic textile. The fibers are formed by the attenuation of the molten plastic caused by discharging the polymer in a field or wall of heated high velocity gas such as air. The process of superheating a volume of air to a desired temperature has typically been realized with the use of electric heaters and/or gas fire heat exchangers. To further improve the efficiency of the melt blowing process, a direct flame chamber 180 and an air compressor 181 may be used. The air compressor 181 pumps air into the direct flame chamber 180 where the air is heated to the desired temperature, typically between 700 degrees and 800 degrees and channeled through piping (not shown) into the air chamber 142. The air may be directly fed to the air chamber 142 or channeled to air chamber 142 through a passage in the die head 120. The direct flame chamber 180 may be fueled with a direct gas line. In addition, further efficiency can be realized with the use of a sensor feedback loop, well known to those skilled in the art, incorporated in the air chamber 142 to provide necessary information for flame modulation so the desired temperature can be efficiently maintained.

The nozzles 130 must extend from the die head 120 through the air chamber 142 a sufficient distance beyond the strand plate 140 to avoid the effect on the blown fiber of turbulence from the gas adjacent the nozzles 130. The length to diameter ratio of each nozzle 130 is generally greater than 25 to 1 where the length is on the order of inches while the diameter is on the order of thirty thousandths of an inch. As a result, the nozzles 130 are relatively flimsy and tend bend under the pressure of the molten plastic passing therethrough. To assure uniformity of the produced material, it is important that the nozzles 130 are aligned to form substantially parallel paths for the plastic. The slightest misalignment will cause degradation in the quality of the product.

In order to maintain proper substantially parallel alignment of nozzles 130, linear alignment strands are placed in contact with and between each of the nozzles 130. In one arrangement of the nozzles 130 according to the present invention, the nozzles 130 are arranged in a rectangular array with rows longer than columns. To maximize airflow, cylindrical strands, as for example music wire having a diameter equal to the nozzle spacing, are placed between each of the rows, alignment strands 402, and each of the columns, alignment strands 401, of the nozzles 130. The alignment strands 401 may rest on a plane above alignment strands 402, or vice versa. In one preferred embodiment, however, the longer strands, the alignment strands 402, are placed below the shorter strands, the alignment strands 401.

Since the alignment strands 401 and 402 are cylindrical, each strand is in tangential contact with the nozzles 130. The force placed by each wire 401 and 402 at the point of tangential contact is balanced by the wire in a 180 degrees advanced position when the nozzle 130 is aligned perpendicular to the longitudinal and latitudinal axes of the strand plate 140. The result is proper alignment of the nozzles 130 so that the flow directed at 0 degrees from the Z-axis and concentric to the annular axis defined by the outside diameter of each nozzle 130. Since air is flowing from the air chamber 142, the arrangement of alignment strands 401 and 402 provides for many small air discharge orifices, four around each nozzle 130 except for those nozzles 130 lying on the outermost row and column of nozzles 130. The result is a high volume of high velocity super heated air discharge around each nozzle 130.

Alignment strands 401 and 402 are secured in place by a cover plate 151 attached to the front end of the strand plate 140. The cover plate 151 includes a plurality of holes or apertures each indicated as 150 corresponding to the arrangement of the nozzles 130 which are concentric with the nozzles 130 and have an inner diameter greater than the outer diameter of the nozzles 130. Each of the nozzles 130 passes through the corresponding hole 150 in cover plate 151 thereby creating an annulus between the cover plate 151 and each nozzle 130 for the super heated air flow necessary to attenuate the discharge polymer into fibers 160.

Figure 6A:
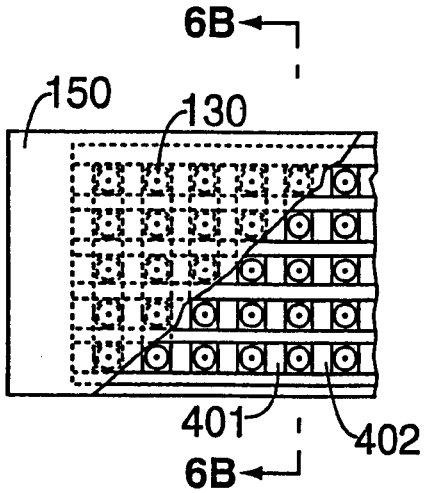
FIG. 6A is a front view of an array of nozzles spaced with alignment strands of the present invention.
Figure 6B:
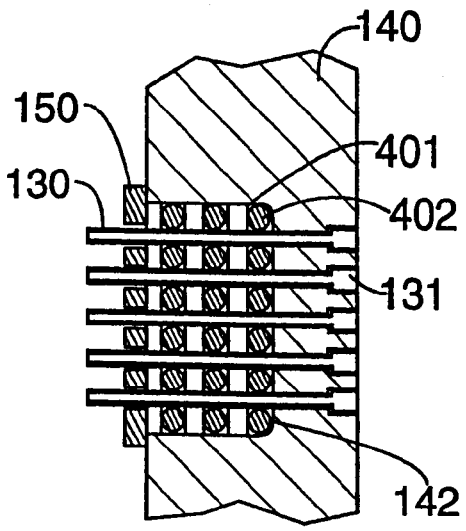
FIG. 6B is a cross-sectional view of the array of nozzles of FIG. 6A.
Figure 6C:
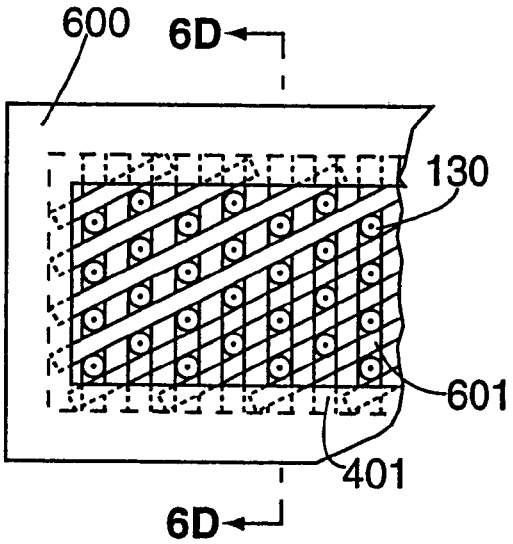
FIG. 6C is a front view of a staggered spatial configuration of an array of nozzles of the present invention.

Since high volume uniform air flow across the entire expanse or face of the nozzles 130 is more important than the annular air flow and manufacturing a cover plate 151 with the holes 150 to align with the corresponding nozzles 130 is difficult, the use of a retainer plate 600 to secure alignment strands 401 and 402 as shown in FIG. 6C to cover the outermost row and column of alignment strands 401 and 402 may be preferred. The alignment strands 401 and 402 are secured in place by physical engagement with the nozzles 130 adjacent each of the alignment strands 401 and 402.

The retainer plate 600 also permits the rows and columns of the nozzles 130 to be placed closer together than is possible with cover plate 151. The reason for this is simply that to create annular air flow, some material must remain between each hole 150. As the holes 150 are packed closer together, less material remains between the holes and cover plate 151 becomes weaker. Moreover, since the diameter of hole 150 is greater than the diameter of each 130, whatever the minimum distance holes 150 must be kept apart the nozzles 130 will be spaced even further apart. By eliminating the cover plate 151 and using the retainer plate 600 there is no material to be concerned with the nozzles 130 may be packed closer together than otherwise possible.

Although the nozzles 130 are depicted in FIG. 7 in a rectangular array configuration, other configurations are possible within the scope of the present invention, and indeed oftentimes desirable. Alternative configuration can be used to counteract a source of quality degradation in the melt blowing process, known as quenching, where the attenuation of the polymer exiting from the mid-level rows of the nozzles 130 is different from the attenuation of the polymer exiting the fringe rows of the nozzles 130. The result is a polymer textile made from nonuniform fibers.

Quenching results from the high velocity, relatively large volume of heated air surrounding the discharged polymer, that creates a large negative pressure around the fringe rows of the nozzles 130. The negative pressure draws in ambient air which alters the effect of the high velocity air around each nozzle 130 on the fringe rows. The mid-level rows, however, are lass effected because the hot polymer discharge from the nozzles 130 on the rows above and below a particular mid-level row heats and thereby blocks the ambient air. Since most of the attenuation of the blown melted plastic occurs approximately within the first inch of travel after discharge from each nozzle 130, the attenuation of the discharged polymer is not consistent between fringe and mid-level rows.

Figure 6D:
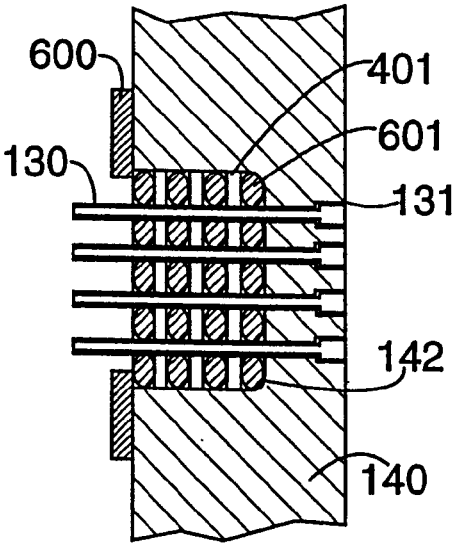
FIG. 6D is a cross-sectional view of the staggered array of nozzles of FIG. 6C.

The effects of quenching can be minimized by using alternative nozzle array configurations, such as staggered rows. FIGS. 6C and 6D show staggered rows. As can be seen in this embodiment, the alignment of the nozzles 130 is maintained with vertical alignment strands 401 as in the non staggered embodiment, and oblique alignment strands 601 determines the column spacing for successive rows of nozzles 130. In the embodiment of FIGS. 6C and 6D, the nozzles 130 in every second row fall within the same column. Similarly, the rows can be staggered so that every third row of nozzles 130 fall within the same column.

The foregoing merely illustrates the principles of the present invention. Those skilled in the art will be able to devise various modifications, which although not explicitly described or shown herein, embody the principles of the invention and are thus within its spirit and scope.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described.

What is claimed is:

1. An apparatus for melt-blowing thermoplastic fibers comprising an extruder having at one end a die head with one or more openings through which molten plastic is extruded; a plurality of nozzles, each of said nozzles having a shoulder of a fixed depth at a back end and a discharge orifice at a front end, said shoulder of each of said nozzles operatively coupled to said die head for receiving said extruded molten plastic; a strand plate having an interior hollow section and an array of nozzle passages arranged in a matrix of rows and columns at a back end through which said plurality of nozzles are inserted to form a corresponding matrix of rows and columns; an air chamber through which said nozzles extend defined by said interior hollow section of said strand plate; means for heating ambient air and delivering said heated air to said air chamber; and means for aligning said nozzles comprising a linear alignment strand disposed between adjacent rows of said nozzles.

2. An apparatus according to claim 1 wherein each said alignment strand comprises a substantially cylindrical element.

3. An apparatus according to claim 1 wherein said array of nozzle passages includes a primary set of columns and rows of nozzle passages and a secondary set of columns and rows of nozzle passages, said strand plate comprising at least one pair of strand plate sections, each of said pairs having a first section having at least one nonvertical edge traversing a plurality of said columns of nozzle passages, and a second section having at least one nonvertical edge complimentary to said nonvertical edge of said first section, said first and second sections juxtaposed along said nonvertical edges, said secondary set of nozzle passages comprising a nozzle passage above each of said primary nozzle passage columns traversed by said nonvertical edge on said first section and a nozzle passage below each of said primary nozzle passage columns, traversed by said nonvertical edge on said second section.

4. An apparatus according to claim 1 wherein said array of nozzle passages at said back end of said strand plate extends with a first diameter a distance substantially equal to said nozzle shoulder depth, within said strand plate to form a recess for said nozzle shoulder, and continues with a second diameter to said air chamber, said second diameter being smaller than said first diameter.

5. An apparatus according to claim 1 wherein said air heating and delivery means comprises a direct flame chamber; a compressor for pumping air into said direct flame chamber; and means for channeling said heated air to said air chamber.

6. An apparatus for melt-blowing thermoplastic fibers comprising an extruder having at one end a die head with one or more openings through which molten plastic is extruded; a plurality of nozzles, each of said nozzles having a shoulder of a fixed depth at a back end and a discharge orifice at a front end, said shoulder of each of said nozzles operatively coupled to said die head for receiving said extruded molten plastic; a strand plate having an interior hollow section and an array of nozzle passages arranged in a matrix of rows and columns at a back end through which said plurality of nozzles are inserted to form a corresponding matrix of rows and columns; an air chamber through which said nozzles extend defined by said interior hollow section of said strand plate; means for heating ambient air and delivering said heated air to said air chamber; and means for aligning said nozzles comprising a linear alignment strand disposed between adjacent columns of said nozzles.

7. An apparatus according to claim 6 wherein each said alignment strand comprises a substantially cylindrical element.

8. An apparatus according to claim 6 wherein said array of nozzle passages includes a primary set of columns and rows of nozzle passages and a secondary set of columns and rows of nozzle passages, said strand plate comprising at least one pair of strand plate sections, each of said pairs having a first section having at least one nonvertical edge traversing a plurality of said columns of nozzle passages, and a second section having at least one nonvertical edge complimentary to said nonvertical edge of said first section, said first and second sections juxtaposed along said nonvertical edges, said secondary set of nozzle passages comprising a nozzle passage above each of said primary nozzle passage columns traversed by said nonvertical edge on said first section and a nozzle passage below each of said primary nozzle passage columns, traversed by said nonvertical edge on said second section.

9. An apparatus according to claim 6 wherein said array of nozzle passages at said back end of said strand plate extends with a first diameter a distance substantially equal to said nozzle shoulder depth, within said strand plate to form a recess for said nozzle shoulder, and continues with a second diameter to said air chamber, said second diameter being smaller than said first diameter.

10. An apparatus according to claim 6 wherein said air heating and delivery means comprises a direct flame chamber; a compressor for pumping air into said direct flame chamber; and means for channeling said heated air to said air chamber.

11. A n apparatus for melt-blowing thermoplastic fibers comprising an extruder having at one end a die head with one or more openings through which molten plastic is extruded; a plurality of nozzles, each of said nozzles having as houlder of a fixed depth at a back end and a discharge orifice at a front end, said shoulder of each of said nozzles operatively coupled to said die head for receiving said extruded molten plastic; a strand plate having an interior hollow section and an array of nozzle passages arranged in a matrix of rows and columns at a back end through which said plurality of nozzles are inserted to form a corresponding matrix of rows and columns; an air chamber through which said nozzles extend defined by said interior hollow section of said strand plate; means for heating ambient air and delivering said heated air to said air chamber; and means for aligning said nozzles comprising a linear alignment strand disposed between adjacent rows and a linear alignment strand disposed between adjacent columns of said nozzles.

12. An apparatus according to claim 11 wherein each said alignment strand comprises a substantially cylindrical element.

13. An apparatus according to claim 11 wherein said array of nozzle passages includes a primary set of columns and rows of nozzle passages and a secondary set of columns and rows of nozzle passages, said strand plate comprising at least one pair of strand plate sections, each of said pairs having a first section having at least one nonvertical edge traversing a plurality of said columns of nozzle passages, and a second section having at least one nonvertical edge complimentary to said nonvertical edge of said first section, said first and second sections juxtaposed along said nonvertical edges, said secondary set of nozzle passages comprising a nozzle passage above each of said primary nozzle passage columns traversed by said nonvertical edge on said first section and a nozzle passage below each of said primary nozzle passage columns, traversed by said nonvertical edge on said second section.

14. An apparatus according to claim 11 wherein said array of nozzle passages at said back end of said strand plate extends with a first diameter a distance substantially equal to said nozzle shoulder depth, within said strand plate to form a recess for said nozzle shoulder, and continues with a second diameter to said air chamber, said second diameter being smaller than said first diameter.

15. An apparatus according to claim 11 wherein said air heating and delivery means comprises a direct flame chamber; a compressor for pumping air into said direct flame chamber; and means for channeling said heated air to said air chamber.

16. An apparatus for melt-blowing thermoplastic fibers comprising an extruder having at one end a die head with one or more openings through which molten plastic is extruded; a plurality of nozzles, each of said nozzles having a shoulder of a fixed depth at a back end and a discharge orifice at a front end, said shoulder of each of said nozzles operatively coupled to said die head for receiving said extruded molten plastic; a strand plate having an interior hollow section and an array of nozzle passages arranged in a matrix of rows and columns at a back end through which said plurality of nozzles are inserted to form a corresponding matrix of rows and columns; an air chamber through which said nozzles extend defined by said interior hollow section of said strand plate; means for heating ambient air and delivering said heated air to said air chamber; and means for aligning said nozzles comprising a linear alignment strand disposed between adjacent nozzles of each said column on a diagonal relative to said rows and said columns of said nozzles.

17. An apparatus according to claim 16 wherein each said individual alignment strand comprises a substantially cylindrical element.

18. An apparatus according to claim 16 wherein said array of nozzle passages includes a primary set of columns and rows of nozzle passages and a secondary set of columns and rows of nozzle passages, said strand plate comprising at least one pair of strand plate sections, each of said pairs having a first section having at least one nonvertical edge traversing a plurality of said columns of nozzle passages, and a second section having at least one nonvertical edge complimentary to said nonvertical edge of said first section, said first and second sections juxtaposed along said nonvertical edges, said secondary set of nozzle passages comprising a nozzle passage above each of said primary nozzle passage columns traversed by said nonvertical edge on said first section and a nozzle passage below each of said primary nozzle passage columns, traversed by said nonvertical edge on said second section.

19. An apparatus according to claim 16 wherein said array of nozzle passages at said back end of said strand plate extends with a first diameter a distance substantially equal to said nozzle shoulder depth, within said strand plate to form a recess for said nozzle shoulder, and continues with a second diameter to said air chamber, said second diameter being smaller than said first diameter.

20. An apparatus according to claim 16 wherein said air heating and delivery means comprises a direct flame chamber; a compressor for pumping air into said direct flame chamber; and means for channeling said heated air to said air chamber.

* * * * *